US009744642B2

(12) United States Patent
Chen et al.

(10) Patent No.: US 9,744,642 B2
(45) Date of Patent: Aug. 29, 2017

(54) SLURRY FEED SYSTEM AND METHOD OF PROVIDING SLURRY TO CHEMICAL MECHANICAL PLANARIZATION STATION

(71) Applicant: TAIWAN SEMICONDUCTOR MANUFACTURING CO., LTD., Hsinchu (TW)

(72) Inventors: Tsung-Huang Chen, Hsinchu County (TW); Wei-Cheng Li, Keelung (TW); Chi-Tung Lai, Hsinchu (TW); Yung-Ti Hung, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 675 days.

(21) Appl. No.: 14/066,381

(22) Filed: Oct. 29, 2013

(65) Prior Publication Data

US 2015/0117135 A1 Apr. 30, 2015

(51) Int. Cl.
*B24B 57/02* (2006.01)
*B24B 37/04* (2012.01)

(52) U.S. Cl.
CPC ..... *B24B 57/02* (2013.01); *B24B 37/04* (2013.01)

(58) Field of Classification Search
None
See application file for complete search history.

(56) References Cited

U.S. PATENT DOCUMENTS 5,520,744 A * 5/1996 Fujikawa ..... H01L 21/67028 134/102.1
6,090,217 A * 7/2000 Kittle ..... H01L 21/67028 134/11
6,296,555 B1 * 10/2001 Inaba ..... B24B 37/345 451/282
2002/0160698 A1 * 10/2002 Sato ..... B24B 7/228 451/67
2004/0194806 A1 * 10/2004 Yang ..... H01L 21/67034 134/18
2005/0054272 A1 * 3/2005 Takahashi ..... B24B 37/30 451/41
2005/0091874 A1 * 5/2005 Chen ..... H01L 21/02063 34/445
2005/0092620 A1 * 5/2005 Mavliev ..... B23H 5/08 205/662
2006/0135047 A1 * 6/2006 Sheydayi ..... H01L 21/67057 451/41

(Continued)

*Primary Examiner* — Abbas Rashid
(74) *Attorney, Agent, or Firm* — McDermott Will & Emery LLP

(57) ABSTRACT

A slurry feed system includes a valve manifold, a mixing tank, a slurry feed pump, a surface tension meter and suction piping, discharge piping as well as slurry return piping. The valve manifold includes inlet piping, outlet piping fluidly coupled to the inlet piping, and a slurry discharge header for supplying slurry to CMP stations. The slurry feed pump is connected to the mixing tank by the suction piping. The discharge piping is routed from the slurry feed pump to the inlet piping of the valve manifold. The slurry return piping is routed from the outlet piping of the valve manifold to the mixing tank. The suction piping, the discharge piping, the inlet piping, the outlet piping and the slurry return piping define a first slurry supply loop. The surface tension meter is coupled to the first slurry supply loop.

21 Claims, 3 Drawing Sheets

(56) References Cited

U.S. PATENT DOCUMENTS

| | | | | |
|---|---|---|---|---|
| 2008/0043213 | A1* | 2/2008 | Shiraishi | H05G 2/003 355/67 |
| 2009/0032067 | A1* | 2/2009 | Kojimaru | H01L 21/67034 134/26 |
| 2009/0038779 | A1* | 2/2009 | Courtright | F24J 3/085 165/104.19 |
| 2009/0165819 | A1* | 7/2009 | Hayamizu | B08B 3/08 134/10 |
| 2009/0185149 | A1* | 7/2009 | Sewell | G03F 7/70341 355/30 |
| 2010/0035515 | A1* | 2/2010 | Marks | B24B 37/015 451/5 |
| 2011/0115223 | A1* | 5/2011 | Stahlkopf | F01K 13/02 290/7 |

* cited by examiner

SLURRY FEED SYSTEM AND METHOD OF PROVIDING SLURRY TO CHEMICAL MECHANICAL PLANARIZATION STATION

BACKGROUND

Semiconductor integrated circuits are formed by building multiple stacked layers of materials and components on a semiconductor substrate. The semiconductor devices typically include a number of electrically active components formed on the substrate. Metal conductor interconnects are formed to electrically couple the active components together by means of circuit paths or traces formed within one or more dielectric layers. Semiconductor fabrication entails a repetitive sequence of process steps including material deposition, photolithographic patterning, and material removal such as etching and ashing which gradually build the semiconductor devices. Chemical-mechanical polishing or planarization (CMP) is a technique used in semiconductor fabrication for planarization of the layer formed on the substrate in order to provide a uniform surface profile. CMP basically entails use of a polishing apparatus that is supplied with slurry which contains an abrasive, deionized water and chemical solvents, and the slurry affects the results of CMP.

BRIEF DESCRIPTION OF THE DRAWINGS

Embodiments of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
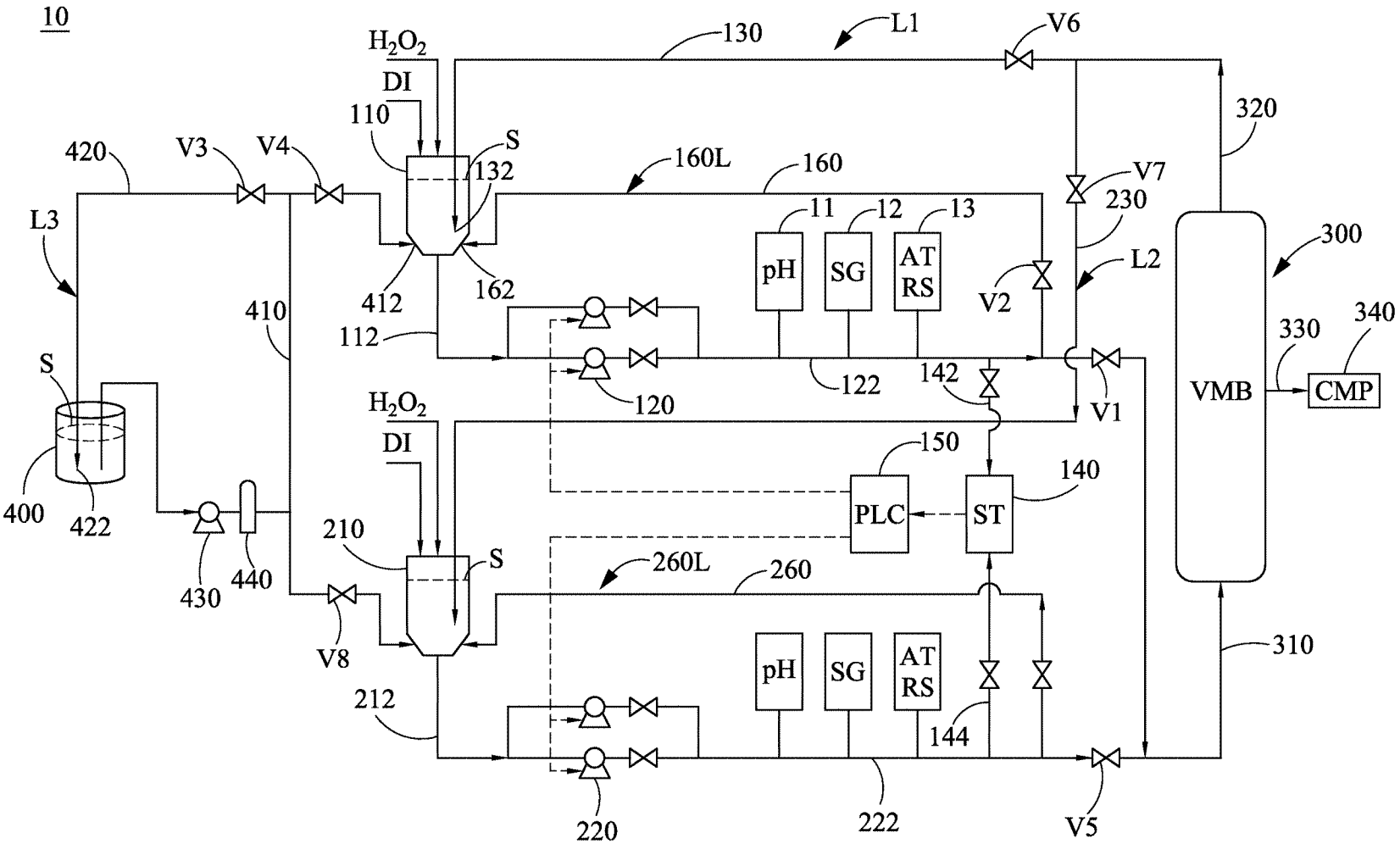
FIG. 1 is a schematic diagram illustrating a slurry feed system according to various embodiments of the present disclosure.

In the following detailed description, for purposes of explanation, numerous specific details are set forth in order to provide a thorough understanding of the disclosed embodiments. It will be apparent, however, that one or more embodiments may be practiced without these specific details. In the drawings, the thickness and width of layers and regions are exaggerated for clarity. Like reference numerals in the drawings denote like elements. The elements and regions illustrated in the figures are schematic in nature, and thus relative sizes or intervals illustrated in the figures are not intended to limit the scope of the present disclosure.

The present disclosure relates generally to a slurry feed system for chemical mechanical planarization (CMP) in a semiconductor fabrication facility. Specific examples of components and arrangements are described below to simplify the present disclosure. These are, of course, merely examples and are not intended to be limiting. For instance, the formation of a first feature over or on a second feature in the description may include embodiments in which the first and second features are formed in direct contact, and may also include embodiments in which additional features may be formed between the first and second features, such that the first and second features may not be in direct contact. Additionally, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "below," "beneath," "above," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. For example, if the device in the figures is turned over, elements described as being "below" or "beneath" other elements or features would then be oriented "above" the other elements or features. Thus, the exemplary term "below" can encompass both an orientation of above and below.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the terms "line," "piping," and "tubing" are used interchangeably and refer to any type, size, or configuration of flow conduit conventionally used in the art for transporting liquids (including slurries) and/or gaseous materials and combinations thereof.

FIG. 1 is a schematic diagram illustrating a slurry feed system 10 according to various embodiments of the present disclosure. The slurry feed system 10 is suitable for chemical mechanical planarization (CMP) in a semiconductor fabrication facility, and includes a first mixing tank 110, a first slurry feed pump 120, a surface tension meter 140 and a valve manifold 300.

The first mixing tank 110 is provided for preparing a dilute slurry mixture suitable for use in CMP stations. According to some embodiments of the present disclosure, undiluted concentrated slurry is transported to the first mixing tank 110, and is mixed with deionized water (DI water) and a chemical or chemicals such as for example $H_2O_2$ to form the dilute slurry mixture. The first mixing tank 110 may be any suitable size, depending on various application requirements.

The first slurry feed pump 120 is connected to the first mixing tank 110 through first suction piping 112. The first slurry feed pump 120 is configured to take suction from the first mixing tank 110 via the first suction piping 112. The dilute slurry mixture in the first mixing tank 110 is transported to first discharge piping 122 by the first slurry feed pump 120.

The first discharge piping 122 is routed from the first slurry feed pump 120 to the valve manifold 300. The dilute slurry mixture in the first discharge piping 122 is transported trough the valve manifold 300 to one or more CMP stations 340.

The valve manifold 300 includes inlet piping 310, outlet piping 320 and a slurry discharge header 330. The first discharge piping 122 is routed from the first slurry feed pump 120 to the inlet piping 310. The outlet piping 320 and the slurry discharge header 330 are fluidly coupled to the inlet piping 310 so that the dilute slurry mixture is transported from the inlet piping 310 to both of the outlet piping 320 and the slurry discharge header 330 which supplies slurry to the CMP station 340.

First slurry return piping 130 is routed from the outlet piping 320 of the valve manifold 300 back to the first mixing tank 110, and thereby forming a first slurry supply loop L1. Specifically, the first suction piping 112, the first discharge piping 122, the inlet piping 310, the outlet piping 320 and the first slurry return piping 130 define the first slurry supply loop L1. The dilute slurry mixture (hereinafter refers to as "dilute slurry") may be circulated in the first slurry supply loop L1, in which a portion of the dilute slurry is supplied to the CMP stations through the slurry discharge header 330 of the valve manifold 300.

The surface tension meter 140 is provided for measuring the surface tension of the dilute slurry in the first slurry supply loop L1 so that the surface tension meter 140 is coupled to the first slurry supply loop L1. The surface tension of slurry is a critical factor to the yield of the CMP stations. In some embodiments, when the surface tension of the dilute slurry exceeds a certain value and such slurry is supplied to the CMP stations, the yield of the CMP process significantly drops. In particular, after the silicon wafer has experienced the CMP process, hundreds of pit defects appear on the silicon wafer. It is discovered that surface tension is an important index to the properties of slurry in view of the yield of the CMP process, and it should be measured and/or monitored in a slurry feed system before and/or during supplying slurry to the CMP stations.

Figure 2:
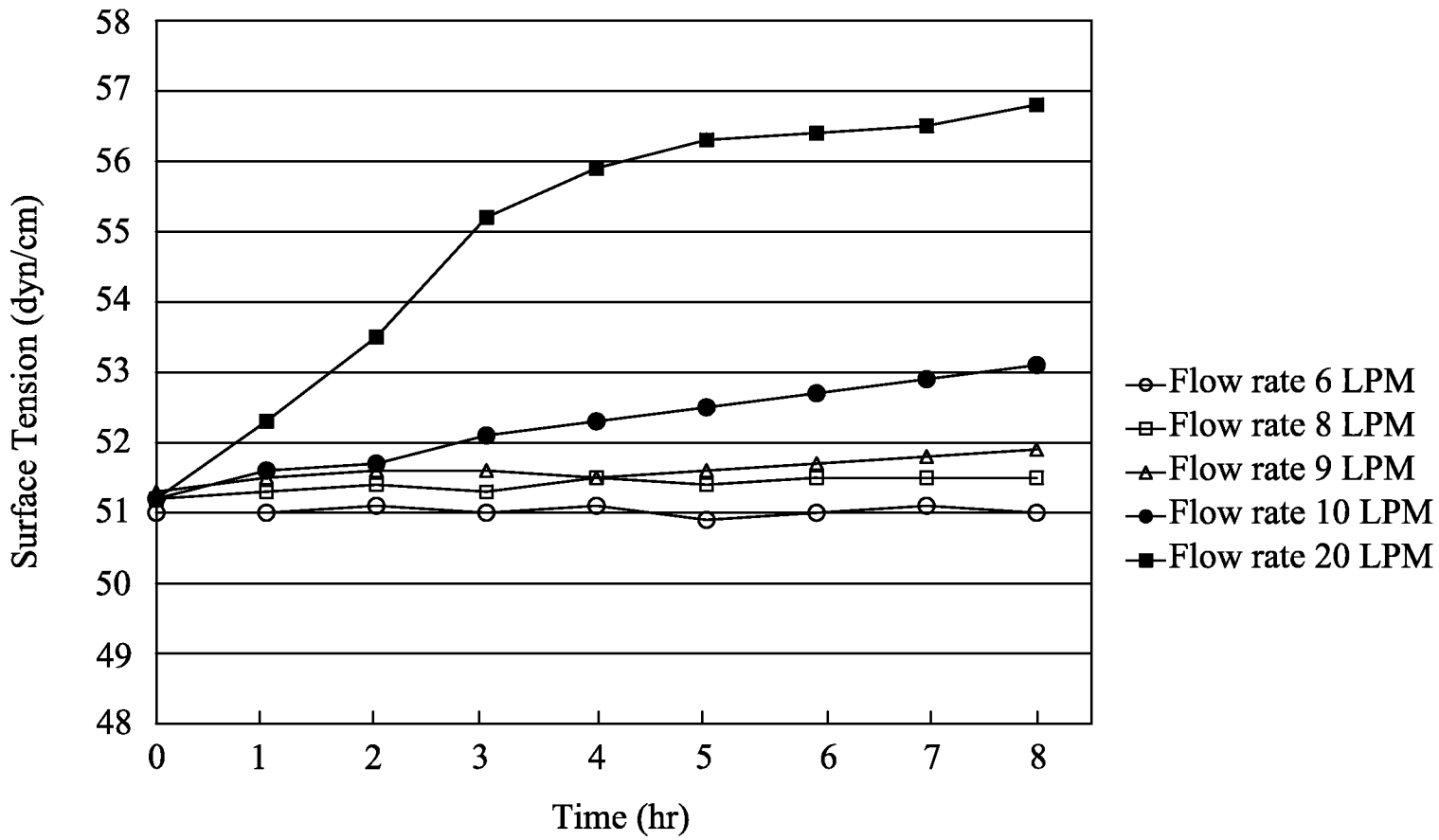
FIG. 2 is a graph showing the surface tension of the dilute slurry at different flow rates according to some embodiments of the present disclosure.

The surface tension of slurry is undesirably changed if the flow rate of the slurry in piping is greater than a certain value. FIG. 2 is a graph showing the surface tension of the dilute slurry at different flow rates according to some embodiments of the present disclosure, in which the dilute slurry is circulated in the first slurry supply loop L1 depicted in FIG. 1. As shown in FIG. 2, the initial surface tension of the dilute slurry is about 51 dyn/cm. When the flow rate of the dilute slurry is 6 litters per minute (LPM), the surface tension of the dilute slurry does not exhibit a considerable variation for a time period of at least 8 hours. To the contrary, when the flow rate of the dilute slurry is 20 LPM, the surface tension of the dilute slurry considerably increases with time. Significantly, when the surface tension of the dilute slurry is greater than a certain value, such as about 53 dyn/cm, such dilute slurry is not accepted for the CMP stations. Accordingly, the surface tension of the dilute slurry should be measured in a slurry feed system. One skilled in the art will appreciate that the above embodiments are provided for illustrative purposes only to further explain applications of some illustrative embodiments and are not meant to limit the disclosure in any manner. For example, the values of the surface tension and the flow rate described above in connection with FIG. 2 may be varied, depending on the piping system and the material of slurry.

According to various embodiments of the present disclosure, the surface tension meter 140 is fluidly coupled to the first slurry supply loop L1 via piping, such as piping 142. In some embodiments, the surface tension meter 140 is configured to measure a surface tension of the dilute slurry in the first discharge piping 122. For example, the surface tension meter 140 is fluidly coupled to the first discharge piping 122 via piping 142. A portion of the dilute slurry is transported to the surface tension meter 140 so that the surface tension meter 140 measures the surface tension of the dilute slurry in the first discharge piping 122. In yet some embodiments, the surface tension meter 140 is configured to measure a surface tension of the dilute slurry in the first suction piping 112. For instance, the surface tension meter 140 may be fluidly connected to the first suction piping 112 via piping (not shown in FIG. 1) arranged therebetween.

According to various embodiments of the present disclosure, the slurry feed system 10 further includes a programmable logic controller (PLC) 150 coupled to both the surface tension meter 140 and the first slurry feed pump 120. In some embodiments, the surface tension meter 140 is capable of providing a signal according to the measured surface tension. The PLC 150 is configured to receive the signal from the surface tension meter 140, and controls the first slurry feed pump 120 according to the signal from the surface tension meter 140. In one example, when the surface tension measured by the surface tension meter 140 exceeds a certain value, the PLC 150 decreases an operation rate of the first slurry feed pump 120, and therefore the flow rate of the dilute slurry in the first slurry supply loop L1 is decreased. In another example, when the surface tension is less than another certain value, the PLC 150 increases an operation rate of the first slurry feed pump 120, and therefore the flow rate of the dilute slurry in the first slurry supply loop L1 is increased.

In operation, the quality of the dilute slurry is checked before the dilute slurry is supplied to the CMP stations according to various embodiments of the present disclosure. In some embodiment, as shown in FIG. 1, the slurry feed system 10 further includes first mixing piping 160 routed from the first discharge piping 122 to the first mixing tank 110. The first mixing piping 160, the first suction piping 112 and the first discharge piping 122 define a first mixing loop 160L. When valve V1 is closed and valve V2 is opened, the dilute slurry is transported back to the first mixing tank 110 from first discharge piping 122 through the first mixing piping 160. The dilute slurry is circulated in the first mixing loop 160L until the dilute slurry is well mixed and has a uniform composition. The surface tension meter 140 is coupled to the first mixing loop 160L to measure the surface tension of the dilute slurry therein. For example, the surface tension meter 140 is fluidly coupled to the first discharge piping 122 through the piping 142. When the quality of the dilute slurry has been determined to be within an acceptable range for the CMP station 340, valve V2 is closed and valve V1 is opened such that the dilute slurry is transported to the valve manifold 300 from the first discharge piping 122. In yet some embodiments, the first mixing piping 160 has an outlet 162 that discharges the dilute slurry back to the first mixing tank 110. The outlet 162 of the first mixing piping 160 is at a position below a slurry level S in the first mixing tank 110 in order to prevent the dilute slurry from generating bubbles or foam in the first mixing tank 110. For examples, the outlet 162 of the first mixing piping 160 is connected to a bottom portion of the first mixing tank 110. The surface tension of the dilute slurry is unfavorably changed when bubbles or foam is formed in the dilute slurry. In yet some embodiments, a pH measurement instrument 11, a specific gravity measurement instrument 12 and/or a chemical concentration measurement instrument 13 are provided to check and/or monitor the quality of the dilute slurry.

According to various embodiments of the present disclosure, the slurry feed system further includes a redundant or standby slurry supply loop which contains components corresponding to the first slurry supply loop L1. With reference to FIG. 1, the slurry feed system further includes a second mixing tank 210, second suction piping 212, a second slurry feed pump 220, second discharge piping 222 and second slurry return piping 230. The second mixing tank 210 is provided for preparing dilute slurry. The second slurry feed pump 220 is connected to and capable of taking suction from the second mixing tank 210 via the second suction piping 212. The second discharge piping 222 is routed from the second slurry feed pump 220 to the inlet piping 310 of the valve manifold 300. The second slurry return piping 230 is routed from the outlet piping 320 of the valve manifold 300 back to the second mixing tank 210, and thereby forming a second slurry supply loop L2. Specifically, the second suction piping 212, the second discharge piping 222, the inlet piping 310, the outlet piping 320 and the second slurry return piping 230 define a second slurry supply loop L2, which serves as a redundant or standby slurry supply loop. The second slurry supply loop L2 supplies dilute slurry to the CMP stations through the valve manifold 300 when the first slurry supply loop L1 runs out of dilute slurry. For example, when valves V5 and V7 are opened and valves V1 and V6 are closed, the slurry supply is switched from the first slurry supply loop L1 to the second slurry supply loop L2.

In some embodiments, the surface tension meter 140 is coupled to the first slurry supply loop L2 via piping 144 for checking the quality of the dilute slurry in the second slurry supply loop L2. Furthermore, the PLC 150 controls the second slurry feed pump 220 according to a surface tension measured by the surface tension meter 140.

Before the second slurry supply loop L2 is in service, the quality of the dilute slurry thereof is checked to be within an acceptable range. In some embodiments, the slurry feed system 10 further includes a second mixing piping 260 routed from the second discharge piping 222 to the second mixing tank 210. The second mixing piping 260, the second suction piping 212 and the second discharge piping 222 define a second mixing loop 260L, in which the dilute slurry may be circulated therein until the dilute slurry is well mixed and has a uniform composition. The surface tension meter 140 is coupled to the second mixing loop 260L via piping, such as piping 144, to measure the surface tension of the dilute slurry in the second mixing loop 260L. When the quality of the dilute slurry has been determined to be within an acceptable range for the CMP stations, the dilute slurry in the second mixing loop 260L is ready to be supplied to the CMP stations.

According to various embodiments of the present disclosure, the slurry feed system 10 further includes a slurry drum 400, first transport piping 410, and recirculation piping 420. The slurry drum 400 is provided for containing undiluted concentrated slurry. The first transport piping 410 is routed from the slurry drum 400 to the first mixing tank 110, and is equipped with a recirculation pump 430 configured to take suction from the slurry drum 400. The recirculation piping 420 is routed from the first transport piping 410 to the slurry drum 400. Therefore, the recirculation piping 420 and the first transport piping 410 define a recirculation loop L3. In some embodiments, when valve V3 is opened and valves V4 and V8 are closed, the concentrated slurry is recirculated in the recirculation loop L3 to prevent the concentrated slurry from precipitation in piping. Furthermore, the first transport piping 410 is equipped with a filter 440 to filter impurities in the concentrated slurry. In yet some embodiments, when both valves V3 and V4 are opened, a portion of the concentrated slurry is transported to the first mixing tank 110 for preparing the dilute slurry. The first transport piping 410 has an outlet 412 for discharging concentrated slurry into the first mixing tank 110, and the outlet 412 is at a position adjacent to the bottom of the first mixing tank 110 to avoid from generating foam or bubbles during feeding concentrated slurry to the first mixing tank 110. In yet some embodiments, the recirculation piping 420 has an outlet 422 that is positioned below a slurry level S in the slurry drum 400 to prevent the concentrated slurry from generating foam or bubbles. The generated foam or bubbles in the slurry drum 400 unfavorably change the surface tension of the concentrated slurry, and lead to the quality of the dilute slurry in the first slurry supply loop L1 being unfavorably changed. In yet some embodiments, when both valves V3 and V8 are opened and valve V4 is closed, a portion of the concentrated slurry is transported to the second mixing tank 210 for preparing the dilute slurry used in the second slurry supply loop L2.

Figure 3:
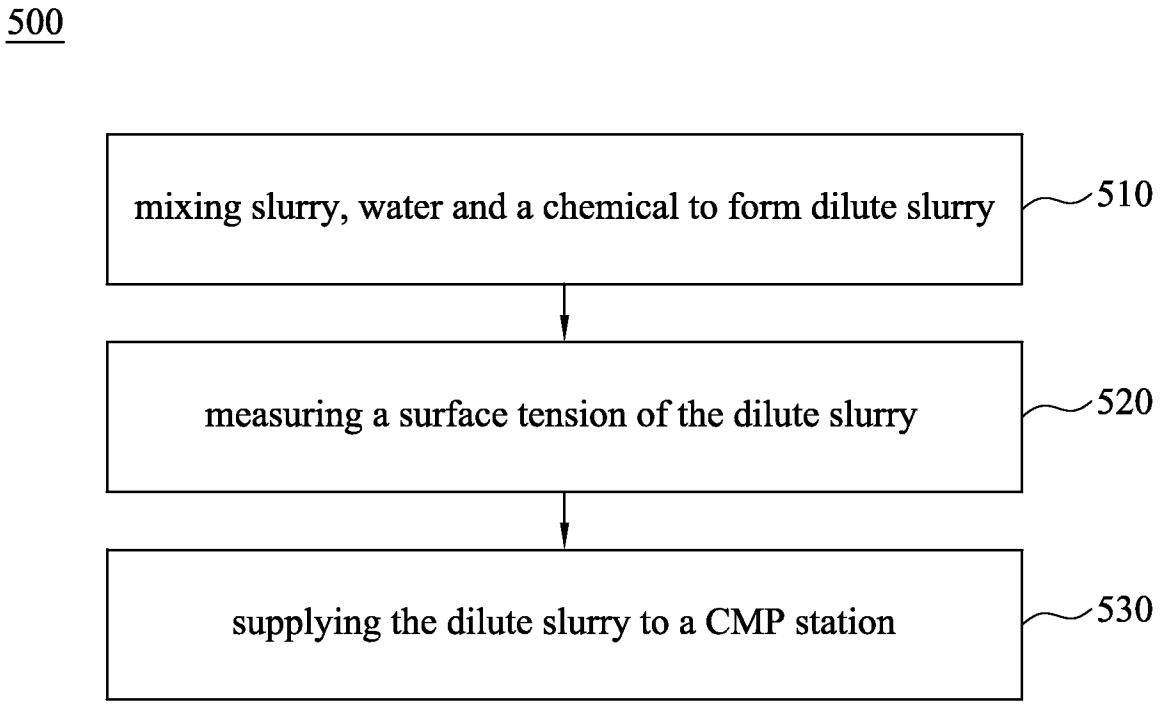
FIG. 3 is a flow chart illustrating a method of providing slurry to a chemical mechanical planarization (CMP) station according to various embodiments of the present disclosure.

According to another aspect of the present disclosure, a method of supplying slurry to a chemical mechanical planarization station is provided. FIG. 3 is a flow chart illustrating a method 500 of providing slurry to a chemical mechanical planarization (CMP) station according to various embodiments of the present disclosure. The method 500 includes act 510, act 520 and act 530.

In act 510, slurry, water and a chemical are mixed to form dilute slurry suitable for the CMP stations. In some embodiments, undiluted concentrated slurry is mixed with DI water and a chemical or chemicals such as for example $H_2O_2$ to form the dilute slurry. In yet some embodiments, the act of mixing the slurry, the water and the chemical includes providing a mixing piping loop, such as for example the first mixing loop 160L shown in FIG. 1, and then allowing the slurry, the water and the chemical to be circulated in the mixing piping loop to form the dilute slurry.

In act 520, a surface tension of the dilute slurry is measured. In some embodiments, the act of measuring the surface tension includes measuring a surface tension of the dilute slurry in the mixing piping loop.

In act 530, the dilute slurry is supplied to CMP station. In some embodiments, the act of supplying the dilute slurry to the CMP station includes providing a supply piping loop, such as for example the slurry supply loop L1 depicted in FIG. 1, that is fluidly connected to the CMP station; and then allowing the dilute slurry to be circulated in the supply piping loop, and to be supplied to the CMP station through the supply piping loop. In some embodiments, the act of measuring the surface tension includes measuring a surface tension of the dilute slurry in the supply piping loop.

According to some embodiments of the present disclosure, the method 500 further includes judging whether or not the surface tension is within a pre-determined range prior to supplying the dilute slurry to the CMP station.

In yet some embodiments, the method 500 further includes modulating a flow rate of the dilute slurry in the supply piping loop according to the measured surface tension of the dilute slurry in the supply piping loop. In one example, the act of modulating the flow rate includes decreasing the flow rate of the dilute slurry when the surface tension is greater than a pre-determined value. In another example, the act of modulating the flow rate includes increasing the flow rate of the dilute slurry when the surface tension is less than another pre-determined value.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A chemical-mechanical planarization (CMP) system in a semiconductor fabrication facility, the CMP system comprising:

at least one chemical-mechanical planarization apparatus;

a valve manifold comprising:

inlet piping;

outlet piping fluidly coupled to the inlet piping; and a slurry discharge header fluidly coupled to the at least one chemical-mechanical planarization apparatus;

a first mixing tank configured to prepare dilute slurry;

a first slurry feed pump connected to the first mixing tank by first suction piping;

first discharge piping routed from the first slurry feed pump to the inlet piping of the valve manifold;

first slurry return piping routed from the outlet piping of the valve manifold to the first mixing tank, wherein the first suction piping, the first discharge piping, the inlet piping, the outlet piping and the first slurry return piping define a first slurry supply loop; and a surface tension meter coupled to the first slurry supply loop.

2. The chemical-mechanical planarization system according to claim 1, wherein the surface tension meter is capable of providing a signal according to a measured surface tension.

3. The chemical-mechanical planarization system according to claim 2, further comprising a programmable logic controller configured to receive the signal and to control the first slurry feed pump according to the signal from the surface tension meter.

4. The chemical-mechanical planarization system according to claim 1, further comprising first mixing piping routed from the first discharge piping to the first mixing tank, wherein the first mixing piping, the first suction piping and the first discharge piping define a first mixing loop.

5. The chemical-mechanical planarization system according to claim 4, wherein the first mixing piping has an outlet configured to discharge the dilute slurry back into the first mixing tank, the outlet being at a position below a slurry level in the first mixing tank.

6. The chemical-mechanical planarization system according to claim 1, wherein the surface tension meter is configured to measure a surface tension of slurry in the first discharge piping.

7. The chemical-mechanical planarization system according to claim 1, wherein the surface tension meter is configured to measure a surface tension of slurry in the first suction piping.

8. The chemical-mechanical planarization system according to claim 1, further comprising:

a slurry drum configured to contain slurry;

first transport piping routed from the slurry drum to the first mixing tank; and recirculation piping routed from the first transport piping to the slurry drum.

9. The chemical-mechanical planarization system according to claim 8, wherein the recirculation piping has an outlet positioned below a slurry level in the slurry drum.

10. The chemical-mechanical planarization system according to claim 1, further comprising:

a second mixing tank configured to prepare dilute slurry;

a second slurry feed pump connected to the second mixing tank by second suction piping;

second discharge piping routed from the second slurry feed pump to the inlet piping of the valve manifold; and second slurry return piping routed from the outlet piping of the valve manifold to the second mixing tank; wherein the second suction piping, the second discharge piping, the inlet piping, the outlet piping and the second slurry return piping define a second slurry supply loop;

wherein the second slurry supply loop is coupled to the surface tension meter.

11. The chemical-mechanical planarization system according to claim 10, further comprising second mixing piping routed from the second discharge piping to the second mixing tank, wherein the second mixing piping, the second suction piping and the second discharge piping define a second mixing loop.

12. The chemical-mechanical planarization system according to claim 10, further comprising a programmable logic controller configured to control the first and second slurry feed pumps according to a signal from the surface tension meter.

13. A chemical-mechanical planarization (CMP) system in a semiconductor fabrication facility, the CMP system comprising:

at least one chemical-mechanical planarization apparatus;

a valve manifold fluidly coupled to the at least one chemical-mechanical planarization apparatus;

a first mixing tank configured to prepare slurry;

a first slurry feed pump connected to the first mixing tank by first suction piping;

first discharge piping routed from the first slurry feed pump to the valve manifold;

first mixing piping routed from the first discharge piping to the first mixing tank, wherein the first mixing piping, the first suction piping and a portion of the first discharge piping constitute a first mixing loop; and a surface tension meter configured to measure a surface tension of slurry in the first mixing loop.

14. The chemical-mechanical planarization system according to claim 13, wherein the surface tension meter is capable of providing a signal according to the measured surface tension.

15. The chemical-mechanical planarization system according to claim 14, further comprising a programmable logic controller configured to receive the signal and to control the first slurry feed pump according to the signal from the surface tension meter.

16. The chemical-mechanical planarization system according to claim 15, wherein the first mixing piping has an outlet configured to discharge the slurry back into the first mixing tank, the outlet being at a position below a slurry level in the first mixing tank.

17. The chemical-mechanical planarization system according to claim 13, wherein the surface tension meter is directly coupled to the first suction piping.

18. The chemical-mechanical planarization system according to claim 13, wherein the surface tension meter is directly coupled to the portion of the first discharge piping.

19. The chemical-mechanical planarization system according to claim 13, further comprising first slurry return piping routed from the valve manifold to the first mixing tank.

20. The chemical-mechanical planarization system according to claim 13, further comprising:

a second mixing tank configured to prepare for preparing slurry;

a second slurry feed pump connected to the second mixing tank by second suction piping;

second discharge piping routed from the second slurry feed pump to the valve manifold; and second mixing piping routed from the second discharge piping to the second mixing tank, wherein the second mixing piping, the second suction piping and a portion of the second discharge piping constitute a second mixing loop;

wherein the surface tension meter is fluidly coupled to the first mixing loop and the second mixing loop.

21. A slurry feeding system for chemical mechanical planarization (CMP) in a semiconductor fabrication facility, the system comprising:

a valve manifold comprising:

inlet piping;

outlet piping fluidly coupled to the inlet piping; and a slurry discharge header configured to supply slurry to at least one CMP station;

a first mixing tank configured to prepare dilute slurry;

a first slurry feed pump connected to the first mixing tank by first suction piping;

first discharge piping routed from the first slurry feed pump to the inlet piping of the valve manifold;

first slurry return piping routed from the outlet piping of the valve manifold to the first mixing tank, wherein the first suction piping, the first discharge piping, the inlet piping, the outlet piping and the first slurry return piping define a first slurry supply loop;

first mixing piping routed from the first discharge piping to the first mixing tank, wherein the first mixing piping, the first suction piping and the first discharge piping define a first mixing loop; and a surface tension meter coupled to the first slurry supply loop.

* * * * *